United States Patent [19]

Greene

[11] Patent Number: 4,463,859

[45] Date of Patent: Aug. 7, 1984

[54] BABY BOTTLE FEEDING SYSTEM

[76] Inventor: Vibert F. Greene, 19400 Sorenson Ave. #213, Cupertino, Calif. 95014

[21] Appl. No.: 379,395

[22] Filed: May 18, 1982

[51] Int. Cl.[3] ..... A61J 9/00; A61J 9/06; A61J 11/04

[52] U.S. Cl. ..... 215/11 R; 215/11 D; 248/103

[58] Field of Search ..... 215/11 R, 11 B, 11 D; 222/335; 248/103

[56] References Cited

U.S. PATENT DOCUMENTS

| | | | |
|---|---|---|---|
| 467,176 | 1/1882 | Jensen | 215/11 D |
| 990,662 | 4/1911 | MacGlashan | 215/11 D |
| 1,045,456 | 11/1912 | Tatum | 215/11 R |
| 1,174,490 | 3/1916 | Gillen | 215/11 R |
| 1,656,157 | 1/1928 | Correnti | 215/11 R |
| 2,107,442 | 2/1938 | Hughes | 215/11 D |
| 2,539,073 | 1/1951 | Grannan | 222/235 X |
| 2,912,200 | 11/1959 | Reinhorn | 248/103 |
| 3,143,429 | 8/1964 | Swanson et al. | 215/11 R X |
| 3,945,524 | 3/1976 | Tkaciukas | 215/11 R |
| 4,301,934 | 11/1981 | Forestal | 215/11 D |

FOREIGN PATENT DOCUMENTS

| | | | |
|---|---|---|---|
| 1088311 | 3/1955 | France | 248/103 |
| 2067416 | 7/1981 | United Kingdom | 215/11 D |

*Primary Examiner*—William Price

*Assistant Examiner*—Sue A. Weaver

*Attorney, Agent, or Firm*—John L. McGannon

[57] ABSTRACT

A versatile feeding system for use by infants and children in which liquid from a bottle is either fed out of the bottle through an adapter, through the improved nipple and into the mouth of the infant or child; or liquid from the bottle is fed out of the bottle through the adapter, through a flexible tube, and into and through a nipple assembly which is adapted to be placed in the mouth of the infant or child.

The adapter includes a pair of halves which are held in place in the open top of the bottle by a screw cap, each half including a flow regulator of resilient material having slits therein which open or close due to suction pressure, and at least one flow restrictor having slots therein for controlling the volume rate of flow of liquid through the adapter. The elongation and deformation of the regulator is controlled by two reducers in one half housing and by one reducer in the other half housing, each reducer has a centrally located hole beveled on one side. The nipple assembly includes a nipple coupled to a rigid extension which couples the opposite end of the tube to the nipple. Once the flow of liquid commences to the nipple assembly, the tube is primed and remains until the bottle and tube are drained. The various parts of the adapter and nipple assembly can be disassembled for cleaning and reassembled for use.

16 Claims, 19 Drawing Figures

BABY BOTTLE FEEDING SYSTEM

BACKGROUND OF THE INVENTION

A conventional baby bottle feeding system for an infant generally includes a feeding bottle with a nipple attached to the open top of the bottle and held in place by a threaded, annular cap. This bottle must be held by a person as the child is being fed from the bottle. In some cases, it may be possible to prop the bottle against a stuffed toy, pillow or the like or to suspend it above the child by some type of suspension device. Holding devices of these types are usually cumbersome and not highly effective to keep the bottle in position until the child has been fed sufficiently from the bottle.

Other problems associated with the conventional baby bottle feeding system include nipple collapse due to vacuum build-up inside the bottle. Even if the nipple does not collapse, the vacuum in the bottle is sufficiently high that it requires a strong suction by the child for the liquid to flow out of the bottle. This usually results in a frustrated, screaming child with sore jaw muscles. Feeding of the child then becomes an unpleasant experience.

In the case of newborn infants and those yet unable to support a bottle, the conventional bottle-nipple arrangement requires support during feeding. Since there are hardly any efficient commercially available holding systems, the usual method of support requires a person to hold the bottle. This limits the activity of the person. Also, in performing other activities, such as driving a car, the car must be stopped to feed the child. If the child is being taken for a walk in a stroller or carrier, the person pushing the stroller must stop to feed the child or else have the bottle propped up in the stroller in some fashion which typically is not very effective.

Another problem encountered in the use of the conventional bottle-nipple arrangement is the weight of the bottle and its contents. Until the child is strong enough or old enough to support the bottle, the child constantly drops the bottle, thus requiring someone to re-position the bottle and the nipple in the child's mouth so that the child can continue to feed. Additionally, there is the problem of leakage when the bottle containing the liquid is lying on its side and not being used.

In view of the foregoing problems, it is desirable to improve upon the conventional bottle-nipple arrangement to avoid the problems mentioned above. Specifically, it is desirable to provide a baby bottle feeding system which should operate as follows:

1. It should eliminate vacuum build-up inside the bottle itself during feeding;
2. It should eliminate nipple collapse.
3. It should allow the liquid to flow freely from the feeding bottle when suction is applied;
4. It should be simple in design but efficient and capable of being easily disassembled for storage or cleaning and easily re-assembled for feeding;
5. It should minimize or eliminate leakage;
6. It should eliminate the need to hold the feeding bottle during feeding;
7. It should be easy to clean;
8. It should be of compact size so that it is not bulky to handle;
9. It should be lightweight in construction and be made to meet all governmental requirements, including the use of disposable material where applicable;

10. It should be safe for use in all of its various applications;
11. It should provide for some of the components to have multiple uses.

None of the conventional or prior art bottle feeding systems so far developed provides for these desirable features. The present invention includes all of such features and, in addition, the invention is simple and rugged in construction, inexpensive to produce, and easy to keep clean.

SUMMARY OF THE INVENTION

The present invention satisfies the aforesaid need by providing a bottle feeding system which includes a bottle having an adapter removably mounted on the open top of the bottle by a screw cap. The adapter can be coupled at one end of a flexible tube for directing the liquid from the bottle into the tube. The opposite end of the tube is coupled to a nipple assembly adapted to be placed in the mouth of the infant or child to be fed.

The adapter can also be used with the improved nipple fitted over the adapter and secured to the bottle by an annular screw cap to form a bottle-nipple arrangement with all the desirable features above. Liquid from the bottle is fed out of the bottle through the adapter, through the improved nipple and into the mouth of the infant or child.

The adapter is provided with a plurality of flow-controlling and strain-controlling elements which are configured and positioned in such sequence so as to prevent vacuum build-up in the bottle yet the elements can be quickly disassembled for cleaning and quickly re-assembled to place the system back in use. Once the flow of liquid from the bottle commences in the tube connecting the adapter and the nipple assembly, the tube remains primed until the contents of the bottle and the liquid in the tube have been drained.

The construction of the nipple assembly and the improved nipple when used with the adapter eliminates nipple collapse. The adapter allows liquid to flow freely from the bottle when suction is applied by the infant or child. Leakage is eliminated by the use of the adapter of the present invention, and the bottle can be held by a support of improved construction so that the bottle is inverted to permit drainage of the contents of the bottle during a feeding session where a flexible tube and nipple assembly are used. The system is also compact in size so that it is not bulky to handle. The parts of the bottle feeding system are lightweight in construction and meet all governmental requirements and the system is suitable for a wide variety of applications.

The primary object of the present invention is to provide an improved bottle feeding system for infants and children wherein the feeding system avoids the problems of conventional baby bottle feeders and allows immediate use yet the parts of the system can be quickly assembled and disassembled and the system is inexpensive to produce and to keep clean.

Other objects of this invention will become apparent as the following specification progresses, reference being had to the accompanying drawings for an illustration of the invention.

IN THE DRAWINGS

Figure 2:
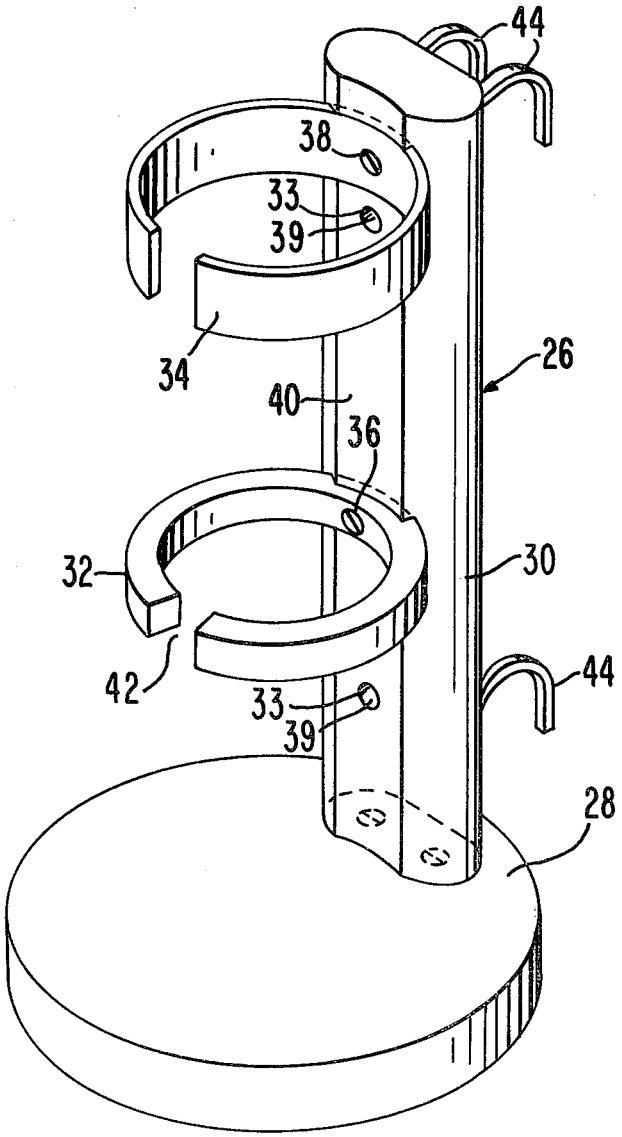
FIG. 2 is an enlarged, perspective view of the bottle holder of the system.
Figure 2A:
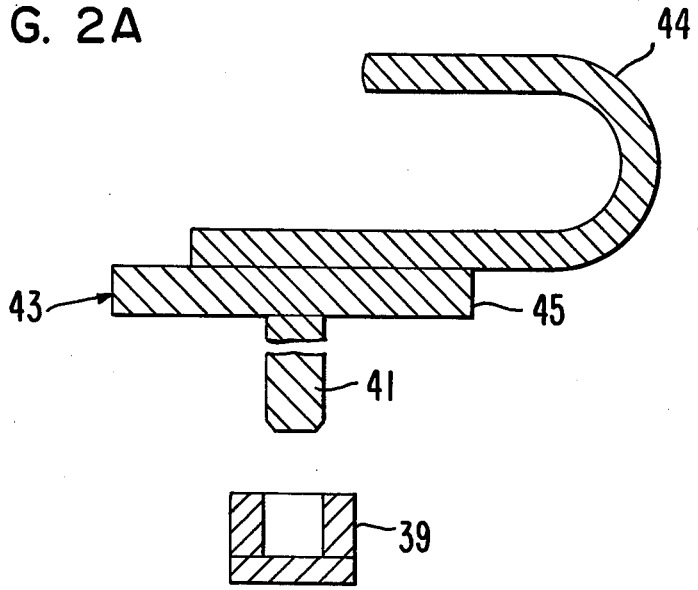
Figure 2B:
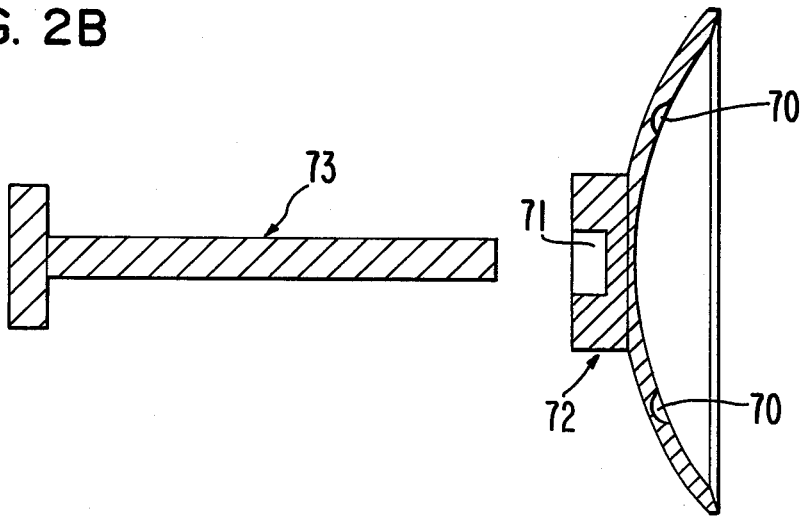
Figure 3:
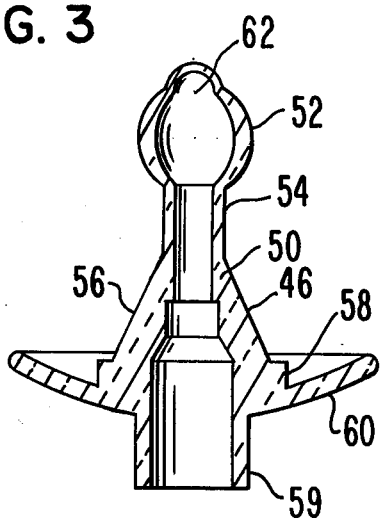
Figure 5:
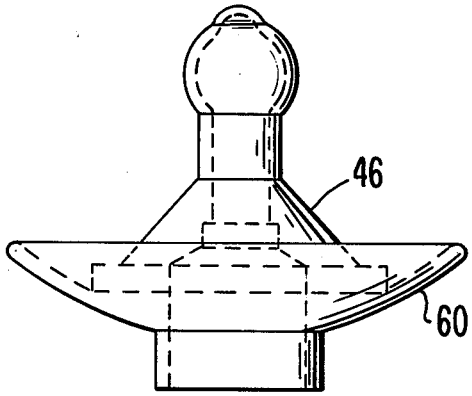
Figure 4:
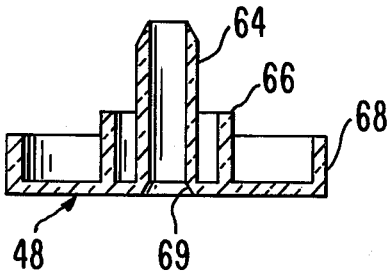
Figure 6:
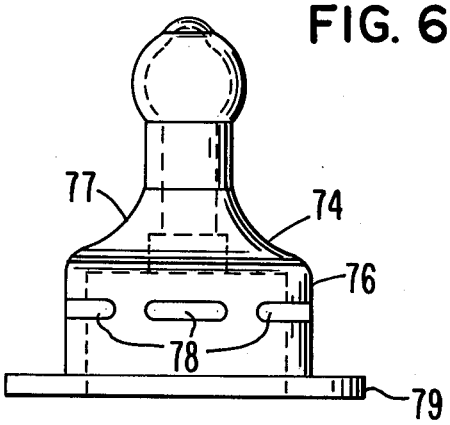
Figure 7:
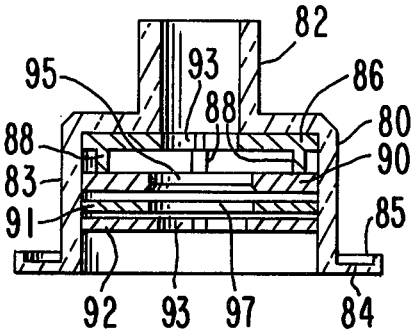
Figure 8:
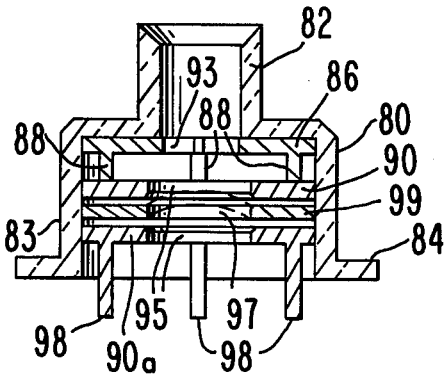
Figure 8A:
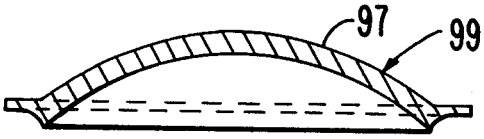
Figure 11:
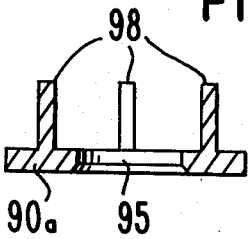
Figure 9:
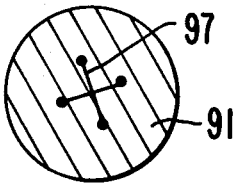
Figure 12:
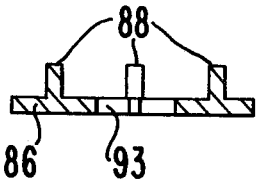
Figure 10:
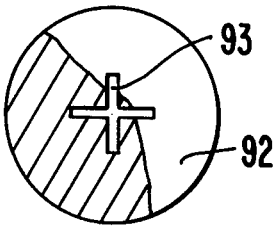
Figure 13:
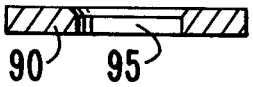
Figure 14:
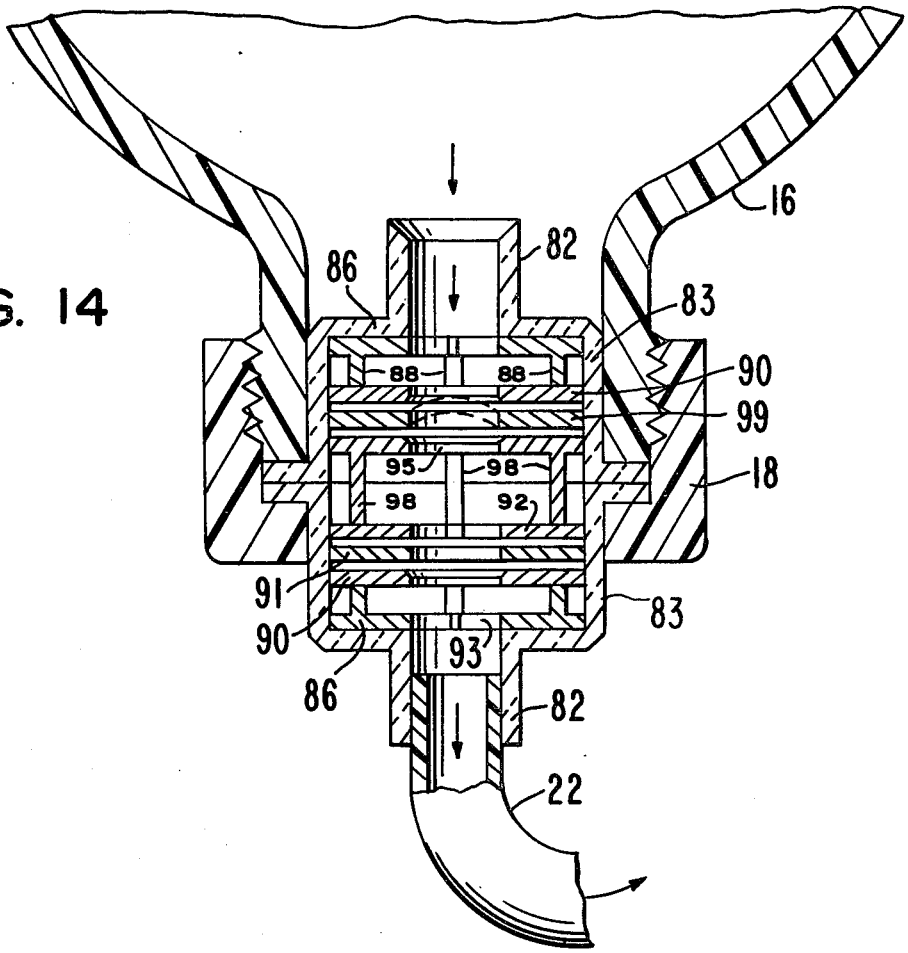
Figure 15:
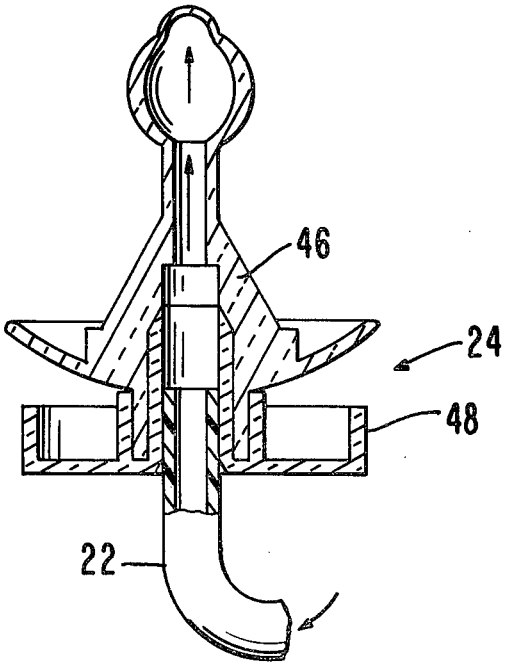
Figure 16:
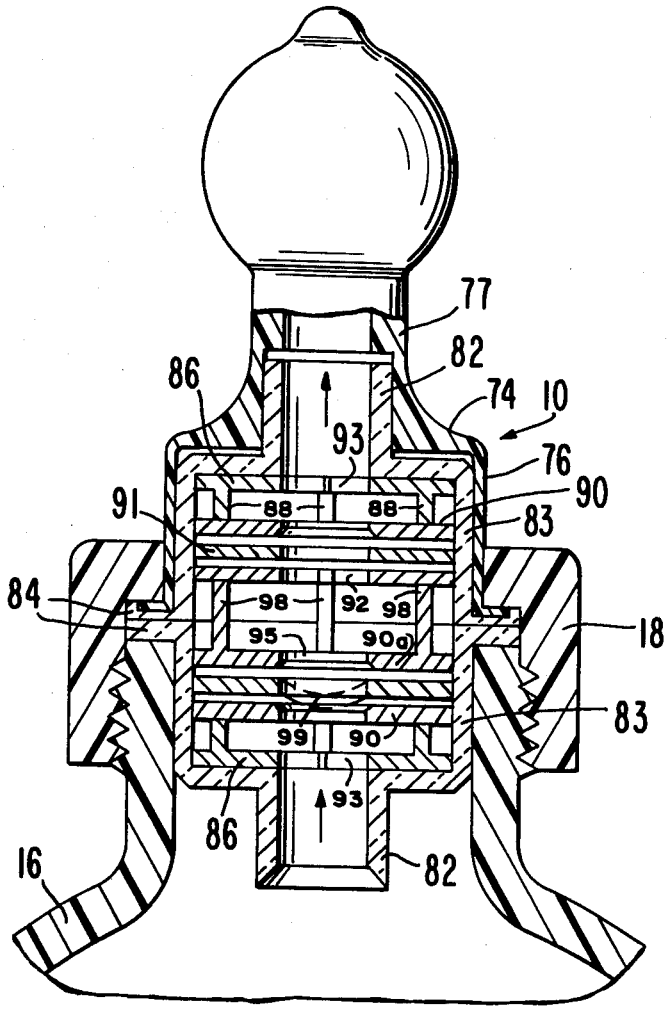

FIGS. 2*a* and 2*b* are side elevational views of a hook and a suction cup, respectively, for the bottle holder of FIG. 2;

FIG. 3 is a vertical section through one embodiment of the nipple of the system;

FIG 4 is a vertical section through an extension for coupling the nipple to the bottle by a flexible tube;

FIG. 5 is a side elevational view of the nipple of FIG. 3;

FIG. 6 is a side elevational view of a second embodiment of a nipple;

FIG. 7 is a vertical section through one-half of an adapter coupling the flexible tube with the bottle;

FIG. 8 is a view similar to FIG. 7 but showing the other half of the adapter;

FIG. 8*a* is a cross-sectional view of a flow regulator for insertion in the other half of the adapter shown in FIG. 8;

FIG. 9 is a plan view of a flow regulator for insertion in one half of the adapter;

FIG. 10 is a plan view of a flow restrictor for one half of the adapter;

FIG. 11 is a vertical section through a strain reducer for one half of the adapter;

FIG. 12 is a view similar to FIG. 10 but showing a second type of restrictor for each adapter;

FIG. 13 is a second type of strain reducer for use in each half of the adapters;

FIG. 14 is an enlarged, fragmentary cross-sectional view of the bottle showing the adapter mounted in place on the neck of the bottle by a screw threaded cap;

FIG. 15 is a cross-sectional view of the nipple of FIG. 3 coupled to the extension of FIG. 4 and a flexible tube connected to the adapter, and coupled to the extension of FIG. 4; and FIG. 16 is a view similar to FIG. 14 except that FIG. 16 shows the nipple of FIG. 6 mounted in place and secured by the same screw-threaded cap.

Figure 1:
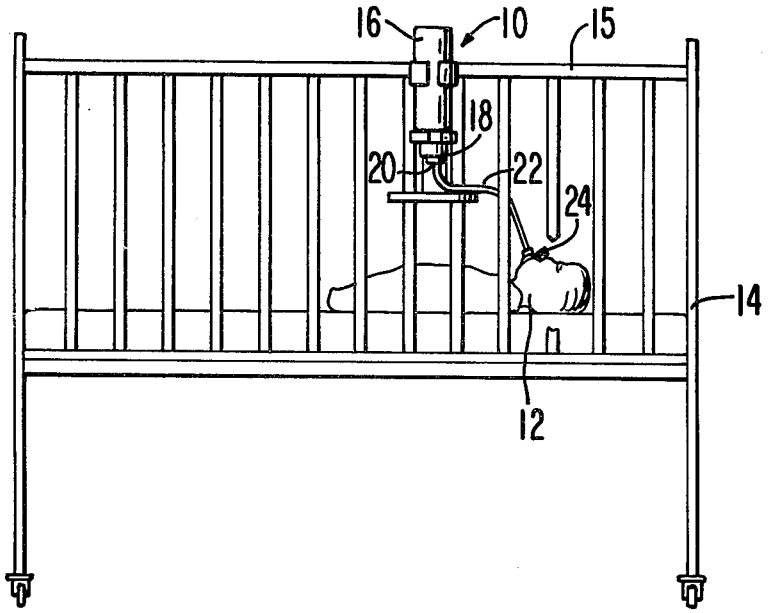
FIG. 1 is a side elevational view of a baby bed showing the bottle feeding system of the present invention as it is being used to feed a child in the bed.

The bottle feeding system of the present invention is broadly denoted by the numeral 10 and is shown in FIGS. 1 and 16. It is usable for feeding a child 12 in a baby bed 14. System 10 can be used in other locations, such as in a stroller, on a high chair, and in an automobile driven by the person attending a child to be fed from system 10.

System 10 is made up of a number of releasably interconnected parts which permit the system to be quickly disassembled for cleaning and re-assembled for immediate use. Moreover, the system is constructed to prevent vacuum build-up, nipple collapse and leakage and assures a steady flow of fluid, such as milk, from the bottle of the system to the nipple in the mouth of the child during a feeding. The bottle and nipple are at a distance from each other in FIG. 1.

System 10 includes a bottle 16 having a cap 18 for holding an adapter 20 in place across the open top of the bottle. In FIG. 1, a flexible tube 22 couples the adapter to a nipple assembly 24 for insertion into the mouth of the child. The adapter, nipple assembly and improved nipple will be described hereinafter with reference to FIGS. 3–16.

FIG. 2 shows a holder 26 for mounting the bottle 16 in a position to be used for delivering a liquid, such as milk, through tube 22. For purposes of illustration, holder 26 comprises a elliptical base 28, and a post 30 extending upwardly from base 28 near one side thereof. A pair of vertically spaced split rings 32 and 34 are secured by screws 36 and 38, respectively to one side 40 of post 30. Ring 32 is of a diameter which is smaller than that of bottle 16 so that the bottle can rest on ring 32 in the manner shown in FIG. 1, yet the cap 18 of the bottle can project through ring 32. Ring 32 has a slot 42 therethrough to permit insertion of tube 22 into the space beneath the ring when the cap 18 is coupled to bottle 16 and tube 22 still coupled to adapter 20.

Ring 34 is of a larger diameter than ring 32 and is of a diameter slightly larger than the outer transverse dimension of bottle 16 so that the bottle can be moved into ring 34 and be held thereby when the portion of the bottle near the neck is supported by ring 32 as shown in FIG. 1. The slot in ring 34 allows tube 22 to pass into the ring as the bottle is mounted in place.

Post 30 supports two hook assemblies each with a pair of hooks 44 near the upper and lower ends thereof for hanging holder 26 onto a horizontal frame member 15 of baby bed 14 or for hanging holder 26 in any position as required by the alternate applications of the feeding system 10. In the alternative, post 30 can be provided with suction cups 72 (FIG. 2*b*) or other attachment means to couple holder 26 to an adjacent structure for supporting bottle 16 in the manner required by the specific application.

Hook assembly 43 is made up of a pair of U-shaped hooks 44 secured to a base 45 that has a centrally positioned straight rod 41 and a cap 39. The hook assembly 43 when mounted on post 30 via a through hole 33 and secured by cap 39 as shown in FIG. 2 allows the hook assembly 43 to rotate 360° on post 30 so that hooks 44 can hang holder 26 in any position and location desired.

Improved suction cup assembly FIG. 2*b* is made up of a suction cup 72 and a straight rod 73 with a round head. The suction cup 72 includes mini-suction cups 70 diametrically located as shown in FIG. 2*b* and separated from each other by 45°. The back end of suction cup 72 has a centrally located hole 71 for coupling rod 73. The suction cup assembly FIG. 2*b* is mounted on post 30 similar to hook assembly 43.

Nipple assembly 24 is shown in detail in FIG. 15. It comprises a nipple 46 and a rigid extension member 48 for coupling one end of tube 22 to the nipple. Nipple 46 and extension 48 are shown separated in FIGS. 3 and 4.

As shown in FIG. 3, nipple 46 has a tubular body 50 provided with an oval shaped head 52 provided with a cylindrical neck 54 coupled to a frusto-conical portion 56 which terminates with a cylindrical extension 58. A dish-shaped, annular member 60 surrounds the base of portion 58 and serves as a mouth guard to prevent a baby from swallowing the nipple. Coupled to the convex side of the dish-shaped member 60 is a cylindrical portion 59 for coupling extension 48 to the nipple 46. Nipple 46 is of a one-piece construction and the nipple has a slitted convex tip 62 at the outer end thereof for allowing fluid to pass therethrough.

Extension 48 is shown in FIG. 4 and includes a pair of concentric, tubular elements 64 and 66 surrounded by a tray-like member 68. Only element 64 has a pair of open ends. Element 64 is a central tube and has one end insertable into cylindrical extension 59 of nipple 46 and element 66 surrounds this extension as shown in FIG. 15. As an alternate, both elements 64 and 66 are inserted into the cylindrical extension 59 of nipple 46. The purpose of member 68 is to permit a person to easily grasp the nipple assembly while keeping the fingers and hands off the nipple itself for sanitary purposes. Also, member 68 provides a means to be grasped to permit separation of the nipple from extension 48. Tube 22 is press-fitted into one end 69 of element 64 to connect the tube to the nipple assembly.

Another view of the nipple 46 is shown in FIG. 5. FIG. 6 shows an improved nipple 74 having a cylindrical portion 76 provided with openings 78 therethrough for viewing the underlying adapter (not shown) to make sure the adapter is properly inserted into the improved nipple 74. The cylindrical portion 76 is coupled to a larger cylindrical portion 79 which functions as a flange for coupling the improved nipple 74 to the adapter by the screw cap as shown in FIG. 16.

The improved nipple 74 is identical to the nipple 46 as shown in FIGS. 3 and 5 from the convex tip 62 to the base of the neck 54. The neck is coupled to a frustum portion 77 which is coupled to the cylindrical portion 76 that terminates with a larger cylindrical section 79. The improved nipple is of a one-piece construction.

Tube 22 which connects adapter 20 to nipple assembly 24 can be of a soft, flexible material which is FDA approved. It can be disposable with a series of corrugations at spaced locations along its length to render it highly flexible. These corrugations allow the tubing to be bent easily to any desired configuration while the remainder of the tube is semi-rigid to eliminate knotting.

Adapter 20 is shown in more detail in its assembled form in FIGS. 14 and 16. The adapter comprises a pair of halves which can be separated and which are shown individually in FIGS. 7 and 8. Each half contains a number of components including an outer holding element 80 having a cylindrical neck 82 coupled to a larger cylindrical section 83 and a flange 84. Element 80, as shown in FIG. 7 with flange 84 having, a groove 85, houses a restrictor element 86 having spaced legs 88, a rigid strain reducer element 90 shown in more detail in FIG. 13, a regulator 91 (FIG. 9), and a restrictor element 92.

Element 80 as shown in FIG. 8 houses a flow restrictor 86 and a strain reducer element 90 identical to those used in FIG. 7. It also houses a regulator 99 and a second type of strain reducer **90*a* having spaced legs 98 as shown in detail in FIGS. 8*a* and 11. Elements 91 and 99 are of resilient material, such as rubber or rubber substitute, and have cross-shaped slits 97 therein. Strain reducer elements 90 and 90*a* have central holes 95 therein as shown in FIGS. 11 and 13 for controlling elongation and deformation of the regulator. Restrictor elements 86 and 92 have cross-shaped slots 93 therein. Element 86 has spaced legs 88 for spacing element 86 from element 90**.

When assembled as part of system 10, the two halves appear as shown in FIGS. 14 and 16 with legs 98 of element **90*a* engaging the adjacent face of element 92 in the other half. Cap 18 bears against the flange of one of the halves while both flanges 84 are forced toward the end face of bottle 16**.

When system 10 is assembled and used in the manner shown in FIG. 1, milk or other liquid in bottle 16 flows out of the bottle through the adapter 20, through tube 22, through the nipple assembly 24 and into the child 12. Once the liquid has flowed into and fills tube 22, the tube remains primed at all times until the bottle is opened or until all of the liquid has been fed. The system 10 as constructed prevents leakage of the liquid yet assure a positive delivery of the liquid through tube 22 and through the nipple assembly or the improved nipple of FIG. 6 for feeding a child. The reducing slots 93 in elements 92 and 86 limit the volume rate of flow of the liquid to tube 22 from the bottle. The slits 97 of elements 91 and 99 serve as valves which open and close when suction is applied on the nipple assembly 24 or the improved nipple 74 by the child. This valve action assures priming of tube 22.

When it is desired to clean the various elements of system 10, cap 18 is removed from the neck of the bottle, allowing the adapter 20 to be separated from the cap and bottle. This is accomplished after first removing tube 22 in system 10 and the improved nipple 74 in FIG. 16 from one of the halves of the adapter, then the adapter halves are separated and the elements inside the halves can be taken out and cleaned by washing. Nipple assembly 24 can be disassembled by separating nipple 46 from extension 48 by pulling outwardly on the extension 48.

After cleaning of the various parts of adapter 20, the improved nipple 74, and nipple assembly 24, the parts are re-assembled and attached to the bottle 16 and are usable once again. The parts are lightweight and are easily handled, they are generally made of plastic that can withstand hot water during cleaning, and do not break when dropped accidentally on the floor. Moreover, the parts are all made from materials which are FDA approved so that the feeding system will meet all requirements for immediate use in feeding of infants and children.

I claim:

1. A baby bottle feeding system comprising: a bottle having an open top; an adapter in the open top of the bottle and having a fluid flow passage therethrough, there being a resilient flow regulator in the adapter and a strain reducer element adjacent to the flow regulator to control elongation and deformation of the flow regulator, said flow regulator normally closing the passage and being responsive to a suction force to open said passage to allow fluid flow therethrough; means coupled with said adapter for releasably securing the same to the bottle; a resilient nipple coupled to the adapter and adapted to be inserted into the mouth of a baby to be fed, whereby a baby sucking on the nipple will cause the passage through the adapter to be opened to permit the flow of fluid from the bottle, through the nipple and to the mouth of the baby.

2. A system as set forth in claim 1, wherein is included a tube interconnecting the adapter and the nipple.

3. A system as set forth in claim 2, wherein is included a flow restrictor in the adapter and formed from a rigid element having a slot therethrough.

4. A system as set forth in claim 1, wherein said flow regulator includes a resilient element having a slit therethrough, said element being deformed in response to a suction force to open said slit and movable to close the slit when suction is removed.

5. A system as set forth in claim 1, wherein said nipple has a rigid extension member secured thereto, said member having an annular body and a central open end tube on the body, one end of said central tube being insertable in said nipple, and a flow delivery tube interconnecting the adapter and the nipple, said flow delivery tube being insertable into the opposite end of the body.

6. A system as set forth in claim 1, wherein is included a holder engageable with the side of the bottle for mounting the bottle in an inverted position.

7. A system as set forth in claim 6, wherein said holder includes a post having a pair of spaced, split rings thereon, one of the rings being of an inner diameter greater than the maximum transverse dimension of the bottle and the other ring being of a diameter less than said dimension of the bottle, and means on the post for removably mounting the post on a support.

8. A system as set forth in claim 7, wherein said mounting means includes a hook.

9. A system as set forth in claim 7, wherein said mounting means includes a suction cup.

10. A baby bottle feeding system comprising: a bottle having an open top; an adapter in the open top of the bottle and having a fluid flow passage therethrough, there being at least a pair of flow regulators in the adapter, said flow regulators being longitudinally aligned with each other and normally closing the passage, said flow regulators being responsive to a suction force to open said passage to allow fluid flow therethrough; at least three strain reducer elements in the adapter adjacent to respective flow regulators; and at least three flow restrictors to limit the volume rate of flow of the fluid through said passage; means coupled with said adapter for releasably securing the same to the bottle; and a resilient nipple coupled to the adapter and adapted to be inserted into the mouth of a baby to be fed.

11. A system as set forth in claim 10, wherein is included a tube interconnecting the adapter and the nipple.

12. A system as set forth in claim 10, wherein the nipple is mounted directly on the adapter.

13. A baby bottle feeding system comprising: a bottle having an open top; an adapter in the open top of the bottle and having a fluid flow passage therethrough, there being a flow regulator in the adapter, said flow regulator including a resilient element having a slit therethrough, said element being deformed in response to a suction force to open the slit and movable to close the slit when suction is removed, said flow regulator normally closing the passage and being responsive to a suction force to open said passage to allow fluid flow therethrough; a rigid strain reducer element in the adapter adjacent to and on the suction side of the resilient element, said rigid element having a central hole therethrough for controlling elongation and deformation of the regulator; means coupled with said adapter for releasably securing the same to the bottle; and a resilient nipple coupled to the adapter and adapted to be inserted into the mouth of a baby to be fed, whereby a baby sucking on the nipple will cause the passage through the adapter to be opened to permit the flow of fluid from the bottle, through the nipple and to the mouth of the baby.

14. A system as set forth in claim 13, wherein said adapter includes a tubular cylindrical body having an end flange engageable with the bottle, said elements being in the body, said securing means including a cap coupled to the bottle.

15. A system as set forth in claim 14, wherein said body includes a pair of separable, axially aligned halves, each half having an end flange, the end flanges engaging each other, the cap being operable to force the end flanges against the end face surrounding the open top of the bottle, each of said halves having a resilient element and a rigid element therein, said spacer means separating the elements in one half from the elements in the other half.

16. A baby bottle feeding system comprising: a bottle having an open top; an adapter in the open top of the bottle and having a fluid flow passage therethrough, there being a flow regulator in the adapter, said flow regulator normally closing the passage and being responsive to a suction force to open said passage to allow fluid flow therethrough; means coupled with said adapter for releasably securing the same to the bottle; a resilient nipple mounted on the adapter and adapted to be inserted into the mouth of a baby to be fed, whereby a baby sucking on the nipple will cause the passage through the adapter to be opened to permit the flow of fluid from the bottle, through the nipple and to the mouth of the baby, said nipple having side openings for viewing the adapter, an end flange and an oval-shaped head with a convex tip.

* * * * *